US006454578B1

(12) United States Patent
Yao

(10) Patent No.: US 6,454,578 B1
(45) Date of Patent: Sep. 24, 2002

(54) FOLDABLE TRANSFORMER

(75) Inventor: Huan Ming Yao, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/893,856

(22) Filed: Jun. 27, 2001

(30) Foreign Application Priority Data

Apr. 13, 2001 (TW) ..... 90205783 U

(51) Int. Cl.[7] ..... H01R 13/44
(52) U.S. Cl. ..... 439/131; 439/174; 320/111
(58) Field of Search ..... 439/131, 171–174, 439/11; 320/107, 111–115

(56) References Cited

U.S. PATENT DOCUMENTS 5,220,152 A * 6/1993 Doran ..... 439/131
5,401,178 A * 3/1995 Liu ..... 439/131
5,494,449 A * 2/1996 Chioo ..... 439/131
6,089,886 A * 7/2000 Mareno ..... 439/131
6,275,002 B1 * 8/2001 Chen ..... 439/131

* cited by examiner

*Primary Examiner*—Hien Vu
(74) *Attorney, Agent, or Firm*—Wei Te Chung

(57) ABSTRACT

A foldable transformer comprises an insulative enclosure (2) and a plug (16) rotatably attached to the enclosure. The enclosure includes a storage cavity (4), a pair of pin holes (14), and a pair of parallel slots (12). An arcuate engaging block (8) is formed on a bridge (10) between the slots. The plug includes a transverse rod (18), a pair of rotary pins (22), and a pair of fixed pins (24) fixed in the pin holes. A groove (20) defined in the rod engagingly accommodates the engaging block. The rotary pins are manually rotated outwardly from the cavity. The engaging block is released from the groove by the rod prosing against the engaging block and thereby elastically deforming the bridge. The rotary pins are rotated out to an unfolded position in which another groove (21) defined in the rod engagingly accommodates the engaging block.

5 Claims, 5 Drawing Sheets

FOLDABLE TRANSFORMER

BACKGROUND OF THE INVENTION

1. Field of the Invention

The present invention relates to transformers for transforming high voltage, alternating current obtained from a conventional electrical power source to low voltage, direct current power, whereby a battery cell is electrically connected with the transformer and conveniently charged. In particular, the present invention relates to transformers having a plug for plugging into a power source outlet, wherein the plug is foldable so that the transformer can be compactly stored when not in use.

2. Description of the Prior Art

U.S. Pat. No. 5,401,178 discloses a conventional foldable transformer. FIG. 4 of the attached drawings shows the transformer having a plug 50, a pair of rotary pins 46, and a pair of internal circuit connection means 48. Each connection means 48 is pivotally connected via a pivot to a corresponding rotary pin 46, such that each rotary pin 46 is pivotally foldable while maintaining constant electric connection with the connection means 48. The plug 50 further includes a rotatable transverse rod 40, an arcuate engaging block 36, and a spring 38. A concave pivot reception 44 is defined in each end of the rod 40, for receiving a corresponding pivot. The rod 40 also has grooves 42 defined therein, and the block 36 also has a protruding engaging ridge 37 for engaging in the grooves 42. A blind hole 39 is defined in an end of the block 36 opposite to the engaging ridge 37, for receiving one end of the spring 38. A substantially box-shaped storage cavity 32 is defined at a junction between a top surface and a front surface of an insulative enclosure 30. The cavity 32 further has an electrical-connection opening 33, and a pin hole 34 for receiving an opposite end of the spring 38.

In assembly, each fixed pin 48 is inserted into a corresponding electrical-connection opening 33. When the rotary pins 46 and rod 40 are rotated to an open position as indicated in FIG. 4, the spring 38 exerts force such that the ridge 37 firmly engages in the corresponding groove 42. The pins 46 are thus securely held in position, allowing the plug 50 to be conveniently inserted into an AC power source outlet.

However, the plug 50 still has the following shortcomings.

1. Its structure has too many components, making it unduly complicated and difficult to manufacture.

2. The spring 38 is not a reliable component. The spring 38 cannot easily be uniformly mass produced, which causes the quality of various plugs 50 to not be uniform. Furthermore, repeated use of the plug 50 may reduce the resiliency of the spring 38 to the point where the spring 38 becomes dysfunctional.

Accordingly, an improved foldable transformer is required.

SUMMARY OF THE INVENTION

Accordingly, an object of the present invention is to provide a plug for a foldable transformer that has a reduced number of components, is easily manufactured and assembled, and is reliable.

In a preferred embodiment, the present invention comprises an insulative enclosure and a plug. The plug is rotatably attached to the enclosure, and electrically connects an electronic circuit within the enclosure with an external power supply. The enclosure includes a storage cavity at the top end thereof. A pair of pin holes is defined in the enclosure at a rear of the cavity. A pair of parallel slots is defined in the enclosure between the pin holes. An arcuate engaging block is integrally formed on a bridge of the enclosure between the slots, by plastic injection. The plug includes a transverse rod, and a pair of rotary pins at opposite ends of the rod. Each rotary pin is pivotally and electrically connected via a pivot to a fixed pin. Each fixed pin is fixed within the corresponding pin hole, and is electrically connected to the electronic circuit. In a folded position, the rotary pins are accommodated entirely within the cavity. A groove defined in the rod engagingly accommodates the engaging block. The rotary pins are manually rotated outwardly from the cavity. The engaging block is released from the groove by the rod pressing against the engaging block and thereby elastically deforming the bridge. The rotary pins are rotated out to an unfolded position where they are perpendicular to the enclosure, and in which another groove defined in the rod engagingly accommodates the engaging block. The rotary pins are then ready to be inserted into a power source.

Other objects, advantages and novel features of the present invention will be drawn from the following detailed embodiment of the present invention with attached drawings, in which:

DETAILED DESCRIPTION OF THE INVENTION

Figure 1:
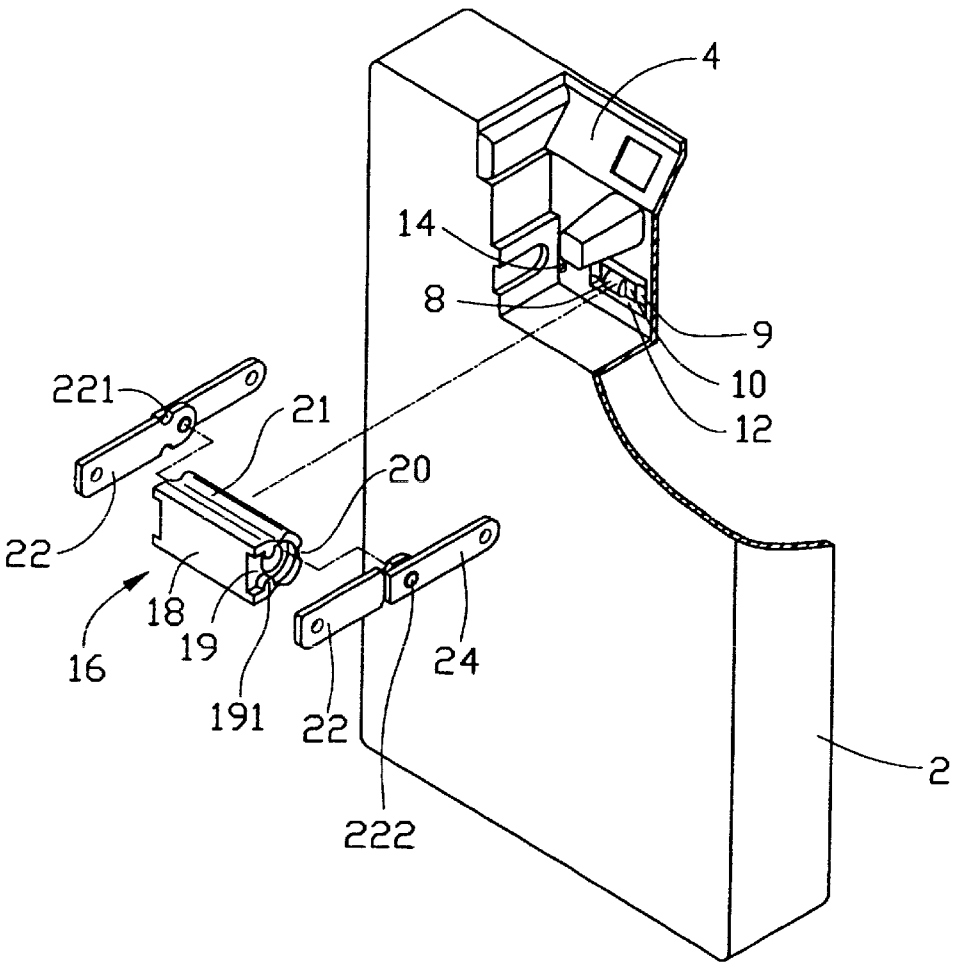
FIG. 1 is an exploded, partially cut-away perspective view of a foldable transformer in accordance with the present invention.
Figure 2A:
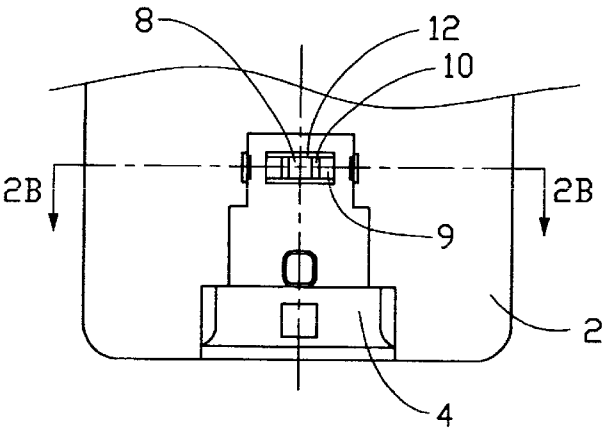
FIG. 2A is a front elevational view of an upper portion of an insulative enclosure of the transformer of FIG. 1, wherein the transformer has been inverted.
Figure 2B:
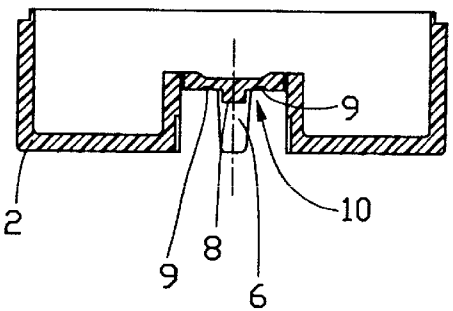
FIG. 2B is a cross-sectional view taken along the line 2B—2B of FIG. 2A.

Referring to FIGS. 1, 2A and 2B, a foldable transformer in accordance with the present invention includes a plug 16 and an insulative enclosure 2 into which an electrical circuit (not shown) for electrical power transformation is received. A storage cavity 4 is defined at a junction of a top surface and a front surface of the enclosure 2. A pair of parallel horizontal slots 12 is defined in the enclosure 2 at a rear of the cavity 4. A bridge 10 is formed in the enclosure 2 between the slots 12. An arcuate engaging block 8 is integrally formed on a central portion of the bridge 10. The engaging block 8 has a generally semicircular cross-section, and protrudes into the cavity 4. A pair of arcuate recesses 9 is defined in the bridge 10 on opposite sides of the engaging block 8 respectively, to enhance resilience of the bridge 10. A pair of pin holes 14 is defined in the enclosure 2 on opposite sides of the bridge 10 respectively.

The plug 16 comprises a transverse rod 18, a pair of rotary pins 22 and a pair of fixed pins 24. First and second longitudinal grooves 20, 21 are defined in the rod 18, for engagingly receiving the engaging block 8 of the enclosure 2. The grooves 20, 21 are spaced 90 degrees from each other, and the rod 18 has a generally arcuate profile between the grooves 20, 21. A pair of keyways 19 is defined in opposite ends of the rod 18 respectively. A pair of opposing protrusions 191 is thereby formed at each end of the rod 18. Each protrusion 191 extends into the keyway 19 and opposes its corresponding protrusion 191 across the keyway 19. Each rotary pin 22 is pivotally and electrically connected to a corresponding fixed pin 24 with a pivot 222. A pair of cutouts 221 is defined in top and bottom edges of each rotary pin 22 near the pivot 222, for engagingly receiving the corresponding protrusions 191 of the rod 18.

In assembly, the rotary pins 22 are engagingly received in the keyways 19 of the rod 18, with the protrusions 191 of the rod 18 being engagingly received in the cutouts 221 of the rotary pins 22. The fixed pins 24 are then inserted into the corresponding pin holes 14 of the enclosure 2. The fixed pins 24 are thereby fixedly connected to the enclosure 2 and electrically connected to the electrical circuit (not shown) within the enclosure 2.

Figure 3B:
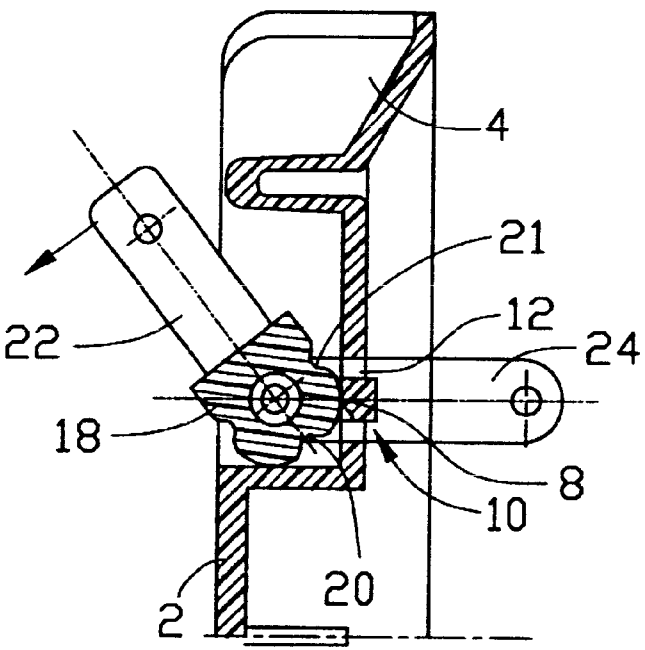
FIGS. 3A–3D are cross-sectional views of an upper portion of the transformer of FIG. 1, showing progressive stages of unfolding and folding of a plug of the transformer.
Figure 3A:
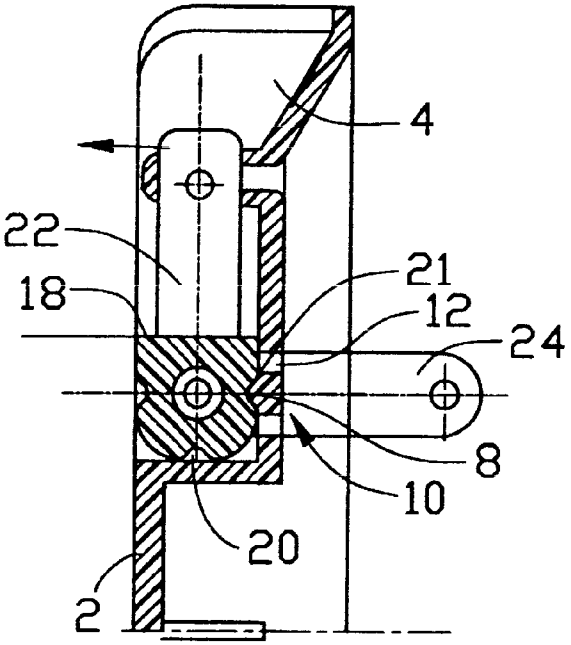

FIG. 3A shows the plug 16 in a folded position. In this position the plug 16 is accommodated entirely within the cavity 4 of the enclosure 2, and the transformer is not in use. The first groove 21 of the rod 18 engagingly accommodates the engaging block 8 of the bridge 10. The plug 16 is thereby firmly secured in the cavity 4.

As shown in FIG. 3B, the rotary pin 22 is manually rotated outwardly from the enclosure 2. The pivot 222 allows the rotary pin 22 to rotate relative to the fixed pin 24 while constantly maintaining electrical connection with the fixed pin 24. A portion of the rod 18 between the second groove 21 and the first groove 20 contacts the engaging block 8, causing the bridge 10 to elastically deform away from the rod 18.

Figure 3D:
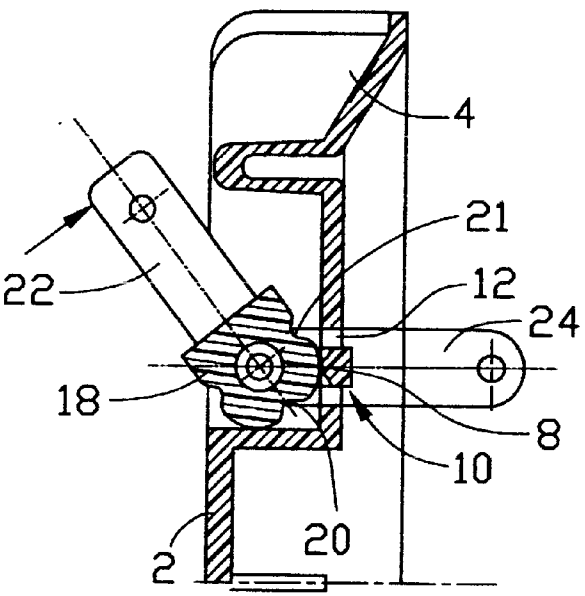
Figure 3C:
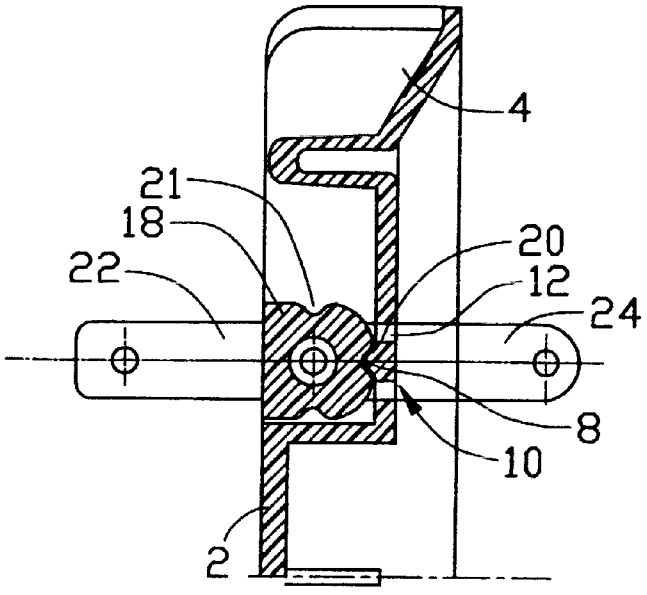
Figure 4:
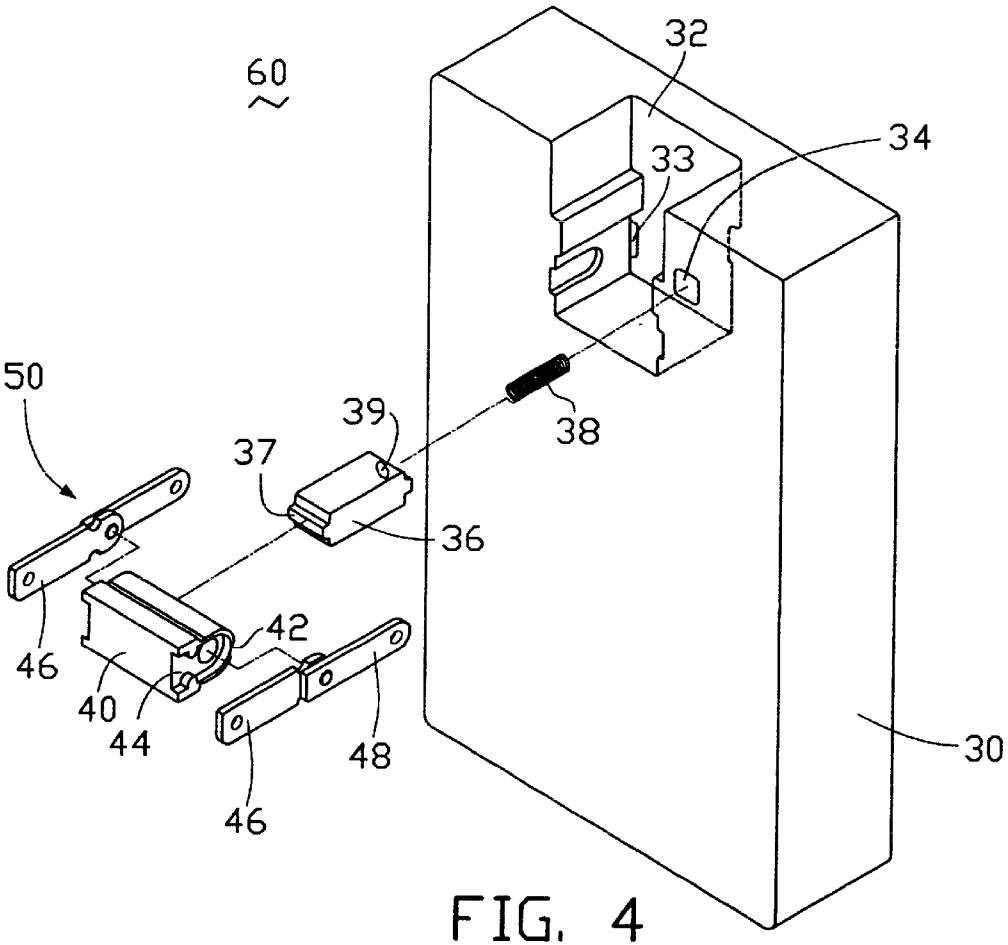
FIG. 4 (PRIOR ART)
FIG. 4 is an exploded perspective view of a conventional foldable transformer.

In FIG. 3C, the rotary pins 22 have been continued to be manually rotated outwardly until the plug 16 is completely unfolded. The engaging block 8 elastically deforms back to its original position and engages in the first groove 20. The rotary pins 22 are thereby fixedly secured in position perpendicular to the storage cavity 4. The rotary pins 22 are then ready to be inserted into a power source In FIG. 3D, the rotary pins 22 are manually rotated back toward the folded position. The rotary pins 22 are then easily returned to the folded position as shown in FIG. 3A.

The present invention has the following advantages:

First, the arcuate engaging block 8, the bridge 10 and the arcuate recesses 9 are all integrally formed in the enclosure 2 by plastic injection molding. The elastic resilience of the bridge 10 allows the engaging block 8 to firmly engage in the second groove 21 or the first groove 20, and the rod 18 to be easily moved between the folded position and the unfolded position.

Second, the resilient bridge 10 obviates the need for any spring, spring prop block and spring pad. This simplifies manufacturing and assembly and reduces costs.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable transformer comprising:

an insulative enclosure defining a cavity;

an insulative engaging block integrally formed with the enclosure and projecting into the cavity; and a plug comprising:

a pair of conductive rotary pins pivotably connected to a pair of fixed pins, respectively; and an insulative rod fixed to the rotary pins and located therebetween, the insulative rod defining first and second grooves, wherein when the rotary pins are rotated to an unfolded position the engaging block engages in the first groove and when the rotary pins are rotated to folded position the engaging block engages in the second groove; wherein a pair of parallel slots is defined in the enclosure at a rear of the cavity, a bridge is formed in the enclosure between the slots, and the engaging block is formed on the bridge; wherein the engaging block is formed on a central portion of the bridge and has an arcuate configuration.

2. The foldable transformer as described in claim 1, wherein the engaging block has a semicircular cross-section.

3. The foldable transformer as described in claim 1, wherein a pair of recesses is defined in the bridge on opposite sides of the engaging block to enhance resilience of the bridge.

4. The foldable transformer as described in claim 3, wherein each recess has an arcuate configuration.

5. A foldable electronic device comprising:

an insulative enclosure defining a cavity therein;

a bridge integrally formed on the enclosure between two slots in a first direction;

an engaging block integrally formed with the enclosure and positioned at a middle portion of the bridge and projecting into the cavity in a second direction perpendicular to said first direction;

a pair of recesses formed in the bridge and by two sides of the engaging block along a third direction perpendicular to both the first direction and the second direction; and a plug rotatably mounted in the cavity with a rotatable transverse rod including foldable pins and engaged with the engaging block; wherein said transverse rod defines variable radii to have the bridge deflected in said second direction and defines thereof an axial direction parallel to said first direction; wherein the engaging block has a semicircular cross-section.

* * * * *